US010669648B1

(12) United States Patent
Weiner

(10) Patent No.: US 10,669,648 B1
(45) Date of Patent: Jun. 2, 2020

(54) TWIST VARIATION

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 107 days.

(21) Appl. No.: 15/938,748

(22) Filed: Mar. 28, 2018

Related U.S. Application Data

(60) Provisional application No. 62/514,166, filed on Jun. 2, 2017.

(51) Int. Cl.

| | |
|---|---|
| ***D01H 1/10*** | (2006.01) |
| ***D01H 7/86*** | (2006.01) |
| *D01H 7/22* | (2006.01) |
| *D01H 1/26* | (2006.01) |

(52) U.S. Cl.
CPC ..... *D01H 1/108* (2013.01); *D01H 7/86* (2013.01); *D01H 1/26* (2013.01); *D01H 7/2291* (2013.01)

(58) Field of Classification Search
CPC ..... D01H 1/108; D01H 1/106; D01H 1/105; D01H 1/26; D01H 1/166; D01H 7/86; D01H 7/2291; D01H 7/862; D01H 7/868
USPC ..... 57/14, 11, 12, 13, 3, 58.3
See application file for complete search history.

(56) References Cited

U.S. PATENT DOCUMENTS 2,442,775 A * 6/1948 Nelson ..... D02G 3/285 57/58.3
2,635,413 A * 4/1953 Truitt ..... D01H 1/006 57/58.52
2,867,967 A * 1/1959 Starnes ..... D01H 1/106 57/315
RE24,840 E * 6/1960 Vibber ..... D01H 1/101 57/58.55
3,192,698 A * 7/1965 Vibber ..... D01H 13/104 57/58.83
3,703,753 A * 11/1972 Binford ..... D02G 1/168 28/220
4,606,181 A * 8/1986 Lappage ..... D02G 3/285 57/58.38
5,263,308 A * 11/1993 Lee ..... D02G 3/285 252/8.84
5,706,642 A * 1/1998 Haselwander ..... D01H 1/10 57/264
6,021,631 A * 2/2000 Prechtel ..... D01H 1/108 57/58.49
6,098,392 A * 8/2000 Tung ..... D02G 3/24 57/11

(Continued)

FOREIGN PATENT DOCUMENTS

JP 01246424 A * 10/1989 ..... D01H 1/105
JP 2007070754 * 3/2007 ..... D02G 3/28

OTHER PUBLICATIONS

English language translation of JP2007070754 to Union Tire, via espacenet.com (last visited Oct. 23, 2019).*

*Primary Examiner* — Shaun R Hurley
*Assistant Examiner* — Patrick J. Lynch
(74) *Attorney, Agent, or Firm* — Stephen J. Stark; Miller & Martin PLLC

(57) ABSTRACT

Methods of using a two-for-one twister are described to twist at least three yarns in various ways to provide desirable yarn constructions. For some embodiments, at least two yarns can balloon about one or more bucket yarns. For some embodiments, bucket yarns can be provided in an innovative manner, whether side-by-side and/or a first bucket yarn feeding through a second supplied bucket yarn.

7 Claims, 3 Drawing Sheets

(56) References Cited

U.S. PATENT DOCUMENTS

| | | | | |
|---|---|---|---|---|
| 6,718,748 | B1 * | 4/2004 | Patterson | D02G 3/385 57/13 |
| 7,513,021 | B1 * | 4/2009 | Haselwander | D01H 7/86 28/247 |
| 8,256,199 | B2 * | 9/2012 | Schlagenhaft | D01H 1/10 57/264 |
| 8,650,849 | B2 * | 2/2014 | Pede-Vogler | D01H 7/86 57/58.86 |
| 9,416,466 | B1 * | 8/2016 | Weiner | D02H 1/00 |

* cited by examiner

TWIST VARIATION

CLAIM OF PRIORITY

This application claims the benefit of U.S. Provisional Application No. 62/514,166 filed Jun. 2, 2017, which is incorporated herein by reference in its entirety.

FIELD OF THE INVENTION

The present invention relates to twisted yarns and more particularly methods and apparatus to twist yarns together in what are believed to be in an effort to create different carpet patterns.

BACKGROUND OF THE INVENTION

Companies such as Volkmann and Verdol have made yarn twisting machines for years.

In common configurations of two-for-one twisters, first a roll of yarn is placed in a pot and possibly fed through a tension device to a loading roll. A second yarn roll which is twisted about the first yarn is fed from a creel like structure normally at an elevated portion above the twister which proceeds downwardly and then around the pot. The second yarn is twisted about first yarn at an eyelet as it is fed to a loading roll. A tension device is also normally utilized on the second feed roll.

Many prior art twisters have a creel location for a third yarn roll near the second yarn roll. The third yarn roll is utilized to tie to the tail of the second yarn so that it can then proceed in an uninterrupted manner after the second roll of yarn expires during the twisting process.

Traditionally, the only variation that could be had during twisting would be to change the tensions either as applied to either the first or the second feed rolls or change the speed of the take up roll so as to potentially change the twist per inch.

By substituting the gearing, it might also be possible to change the speed of rotation of the second yarn about the first yarn through the use of a different gear.

Patents such as U.S. Pat. No. 5,706,642 show a variable twist level yarn which utilizes a controller to be able to change the twist rate on the fly of a traditional two-ply yarn construction. As one can see from that patent, there was no way to change tension.

U.S. Pat. No. 8,650,849 is a yarn feed device which employs ways of changing tension on the first and second yarns.

U.S. Pat. No. 8,256,199 also shows a method for operating a two-for-one twister.

U.S. Pat. No. 6,098,392 shows a rather interesting structure that provides for a way to feed multiple yarns as first and second yarns, respectively, but only in specified ways. In this construction yarns one and two are described as being co-twisted in a single direction to form a creel component yarn having an S or Z twist pattern. While it may be possible to get the technology of U.S. Pat. No. 6,098,392 to work on a certain situation, the applicant has tried some features shown in this patent without success.

However, improvements over all these prior arts technologies have been made by the applicant in an effort to provide relatively unique twist variations to the marketplace through various embodiments.

SUMMARY OF THE INVENTION

It is an object of many of the embodiments of the present invention to provide twisted yarns utilizing a twister and more precisely a two-for-one twister in an effort to twist more than two yarns together to form a single yarn.

It is another object of the present invention to provide improved twist variation to twisted yarn.

Accordingly, in accordance with a presently preferred embodiment of the present invention, a two-for-one twister may be utilized with modification. Specifically, an improved creel and/or usage system is utilized to feed two yarns side by side, as opposed to one about another in a twisted manner at a specific twist rate, and/or through other feed mechanisms possibly including separate and/or then possibly combined tension device(s) which are possibly controllable. The second yarn(s) can then be directed about a pot in which at least the first yarn is located. A plurality of different first yarns, whether fed as shown in U.S. Pat. No. 6,098,392, or possibly in other ways, possibly through their own separate tension device(s) and/or through a common tension device (any of which may be controllable) to then be joined at a ring and then directed to a take-up roll (which could be variable speed with the second yarn(s)).

Accordingly, not only could a consistently cabled looking product be provided with many aspects control with a controller, but also striated looks; which are not possible with the prior art known to the applicant.

Accordingly, by selecting the number of yarns (up to, or even exceeding, nine) to be simultaneously fed as second yarns from a creel, the tensions on the various second yarns which may be independently controllable, and then selecting a number of first yarns to be fed (as well as an ability to change speeds and tensions while taking up on the take-up roll) twist variations can be provided in ways not performed before. The applicant has created a way to generate twist variations which can contribute to desirable design aesthetics in finished carpet and possible other uses.

BRIEF DESCRIPTION OF THE DRAWINGS

The accompanying drawings illustrate preferred embodiments of the invention and, together with the description, serve to explain the invention. These drawings are offered by way of illustration and not by way of limitation.

DETAILED DESCRIPTION OF THE PREFERRED EMBODIMENT

Figure 1:
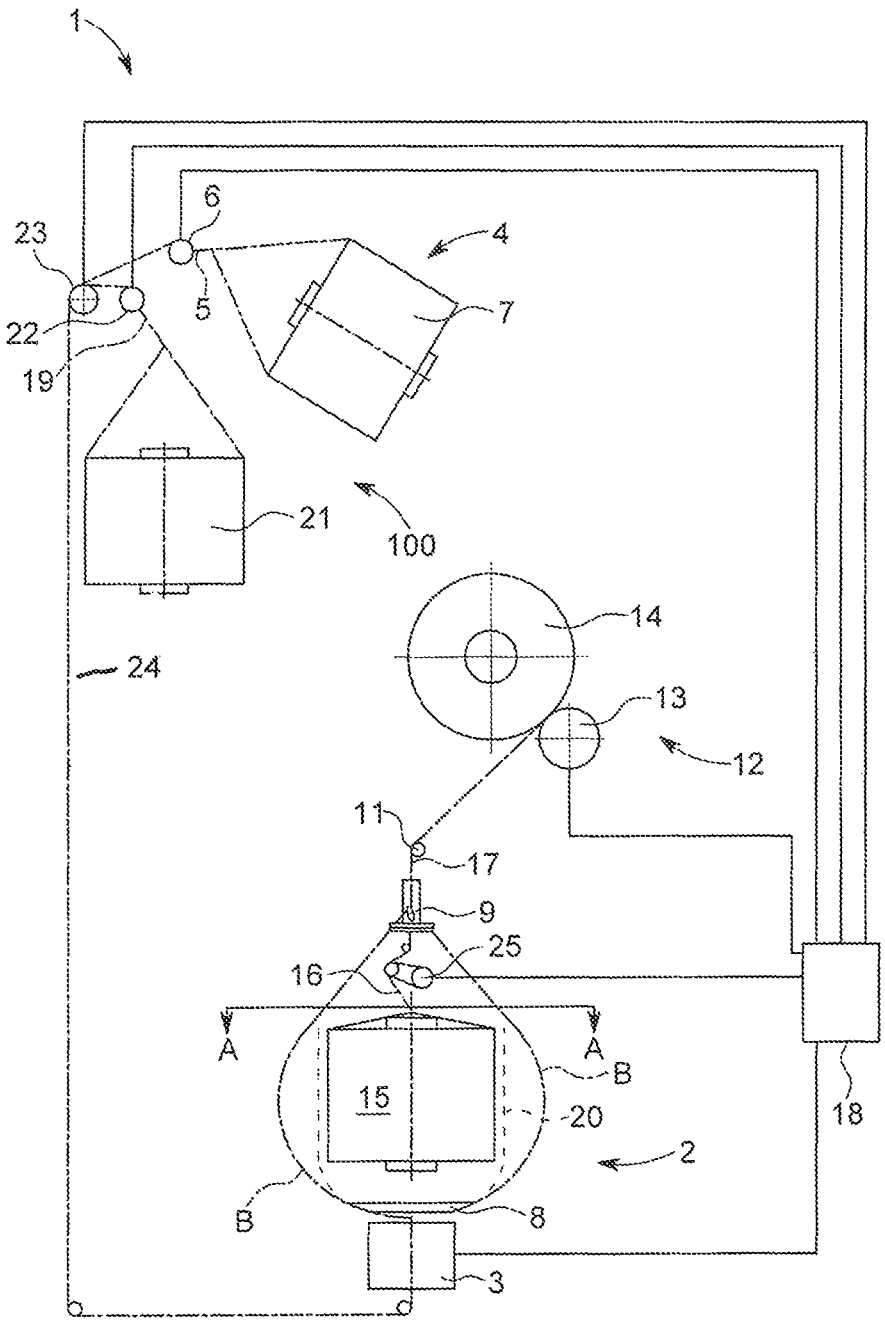
FIG. 1 is a schematic view of a workstation of a twisting machine of presently preferred embodiment of the present invention.

FIG. 1 shows a schematic view of the structure of a workstation 1 of a twister such as those which could be made by Volkmann or Verdol or other companies as modified by the applicant. The workstation 1 has a creel 4, which is used to retain at least a first supplied bobbin 7 from which a so called outer yarn or first yarn 5 is drawn. Furthermore, workstation 1 can comprise a twisting spindle 2 which carries, on twisted yarn plate 8 arranged on the twisting spindle 2, a second supply bobbin 15 which forms a so-called second yarn 16 which is traditionally withdrawn from overhead or from inside of bucket or pot 20 as a bucket component yarn, which is supplied above the twisting spindle 2 to a balloon eyelet 9 or a compensation system 9 of the present embodiment to a twisting regulator. A twisted yarn plate 8 also forms a bottom of a bucket or pot 20 as would be understood by those of ordinary skill in the art for many twisting machines. This workstation 1 is often utilized to provide cable-twisted yarn pairs from component yarns, but only yarn pairs in the prior art.

The first yarn 5 is withdrawn form the first supplied bobbin 7 to be fed to a regulatable yarn tension influencing device 6 which is normally arranged between the creel 4 and the cabling spindle 2 in the yarn course, often by means of which device the yarn tension can be varied remotely with a control mechanism 18. For this purpose, the yarn tension influencing devices can be connected to a control mechanism 18, which can carry out the regulation of yarn tension applied by the device 6. Yarn tension influencing device 6 can be connected upstream of the twisted yarn plate 8, viewed in the yarn withdrawal direction.

Additionally, at least one other outer yarn or third yarn 19 can be fed from third supply bobbin 21 through a separate tensioning device 22 and possibly then both first and third yarns 5,19 could then be co-fed (simultaneously) possibly through another tensioning device 23 to be fed as a combined yarn 24 (adjacent creel component yarns) to the twisted yarn plate 8 (rotating disc) probably with control mechanism 18 (and possibly remotely). First supplied bobbin 7 and third supply bobbin 21 can be a portion of a creel 4.

For many embodiments by having a separate tensioning devices 6,22 the tension on the yarns 5,19 can be controlled to be fed in a desired manner to the twisted yarn plate 8.

Unlike U.S. Pat. No. 6,098,392 which purposefully twists the yarns A and B together from bobbins 1,2, the applicant certainly can perform that step, or alternatively direct the yarns without necessarily performing the same twist action as is done in U.S. Pat. No. 6,098,392 for some embodiments. Instead of a precise twist as is had with patent '392, the applicant can provide one or more of a striated look or parallel look utilizing technology shown and described in this application.

Furthermore, to the extent that the yarns 5 and 19 are intentionally twisted together to form a combined yarn 24, like the '392 patent teaches, the separate tensioning devices 6 and 22 can assist in precisely controlling those yarns 5,19 as opposed to only having a single tension 23 control the tension for the combined yarn 24.

The first and third yarns 5,19 (and/or others) can be directed to run through spindle drive 3 in a rotational direction, and exit the spindle drive 3 below the twisted yarn plate 8. The outer yarns are the first and third yarns 5,19 can be deflected upwardly at the edge of the twisted yarn plate 8 so that the first and third yarns 5,19 can be directed around the second yarn 16 from the second supply bobbin 15 (and/or others) along the cabling spindle 2 with a formation of a free yarn balloon B. The combining eyelet 9 can be where the outer yarn 5 and/or 19 withdrawn from the first supply bobbin 7 and third supply bobbin 21 (and/or others) and the second yarn 16 withdrawn from the second supply bobbin 15 (and/or other) can guide together, to thus determine the height the free yarn balloon B being formed. The combining eyelet 9 is where the twisting and/or cording point at which the yarns 5,19,16 (and/or others) come together to form the corded yarn or twisted yarn 7 as would be fed further in the processing system as will be explained below.

A winding device 12 can be utilized downstream to provide a drive roller 13 and a take-up bobbin 14 by means of frictional engagement with the drive roll 13 to receive the twisted yarn 17 thereon from a yarn guide eyelet. The control mechanism 18 may not only control any of the tension device(s) such as tension devices 6,22,23,25 which might affect the tension coming from the second yarn 16 and/or others (and possibly remotely), but also the speed of the drive roller 13, the spindle drive 3 and/or other portions of the process so as to affect the combination of the yarns as to combined to provide twisted yarn 17 (also known as a cable-twisted yarn) which has at least three component yarns in the embodiments shown and described herein. An ability to achieve a rather unique twisted arrangements and twist variations is believed to be unique. The yarn tension devices 6,22,23 and/or 25 can vary the tension of the yarns 5,9,24,16 etc. The yarn tension devices 6,22,23 can also vary the tension of the combined yarn 24 (independently and/or simultaneously, as applicable, or desired) as fed to the twisted yarn plate 8 as would be understood by those of ordinary skill in the art.

Various tension devices 6,22,23,25 can be electronically controlled brakes or active delivery mechanisms or a combination of the two components as would be understood by those of ordinary skill in the art. There are many tension devices, whether they be variable such as controlled by controller 18, or fixed, which could be set and/or even preset to desired tensions which would be available for various embodiments.

Figure 2:
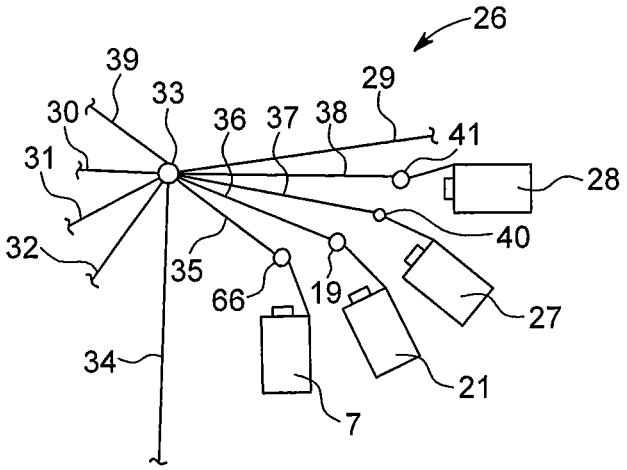
FIG. 2 shows a schematic view of a portion of the workstation shown in FIG. 1 in a first alternatively preferred embodiment.

FIG. 2 shows an alternative embodiment for creel 4 shown in FIG. 1 in the form of creel 26 having first supply bobbin 7, third supply bobbin 21, as well as fourth and fifth supply bobbins 27,28. Other supply bobbins could be utilized to provide additional yarns 29,30,31,32, 39 and/or others to feeder 33 which could be a tension device and/or another feeder such as a roller or eyelet so as to provide the combined yarn 34 to the twister plate 8 as shown in FIG. 1 as would be understood by those of ordinary skill in the art. Additionally, each of the bobbins 7,21,27,28 and/or yarns 29-32, 32 as well as 35,36,37,38 can all have tension applied such as by the various respective tension devices 6,19,39,40 and/or others (independently and/or simultaneously) as would be understood by those of ordinary skill in the art. At least up to nine, or maybe even more, yarns can be co-fed simultaneously as combined yarn 34 and then be twisted with at least second yarn 16 as shown in FIG. 1 possibly each having their own tension devices 6,19,29,40 etc. (more about that will be discussed below).

Although the yarns 29-32,35-39 are shown not being intentionally twisted together as are done in U.S. Pat. No. 6,098,392 at least some of them could be for various embodiments however utilizing the technology it would not be that difficult to modify the creel of the prior art twister in order to provide this feed construction to provide the creel 26. Of course, fewer bobbins 7,21,27,28 and/or others could provide the yarns 29-32,35-39 could be utilized as well in various embodiments. The yarns 29-32,35-39 could be striated, twisted, parallel, and/or otherwise provided in other combinations to provide different twist variations. By providing yarns 29-32,35-39 side by side, they may tend to provide striated patterns or they may be maintained in parallel arrangement to one another for various embodiments.

Figure 3:
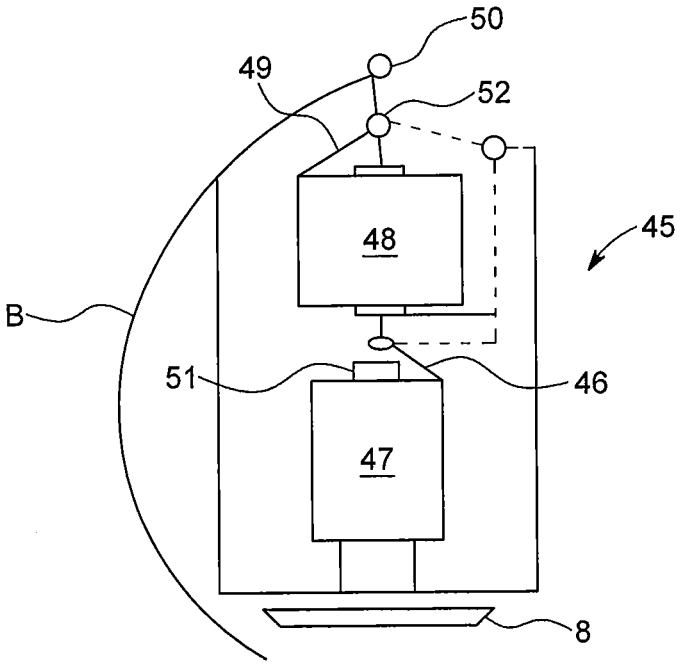
FIG. 3 shows a schematic view of a portion of FIG. 1 in a second alternatively preferred embodiment.

FIG. 3 shows an alternate embodiment of a bucket or pot 45 which replaces the pot 20 shown in FIG. 1 having the twister plate 8 showing the balloon yarn B which would be yarn 34 and/or 24 as is fed to the twister plate 8 as would be understood by those of ordinary skill in the art. This embodiment has a construction somewhat similar to the embodiment shown in FIG. 1 of the '392 patent except that instead of twisting the yarns as is shown in that embodiment, the yarns are twisted in a different manner such as by providing a core cabled as shown as one option with yarn 46 being fed from the center of the lower bobbin 47 through the center of upper bobbin 58 to then be joined by upper yarn 49 to provide combined yarns possibly to a tension device 50 with each of the yarns 46 and 49 being possibly fed through past individual tension devices 51,52 all of which 50,51,52 could be controlled by controller 18 or not for various embodiments.

Additionally, while core cabling is certainly an option for the yarns 46,49, a separate option is shown in FIG. 3 in phantom with the yarn 46 being directed around upper bobbin 48 so that the yarns 46,49 combine together without being subjected to an intentional twist as is shown in solid line in FIG. 3 so that they can provide more of a striated look (or remain parallel). Furthermore, the yarns may be maintained in a fixed (non-twisted, non-striated) orientation (i.e., parallel) just like the various yarns could be done from either of the creels 4 or 26 as described herein.

Figure 4:
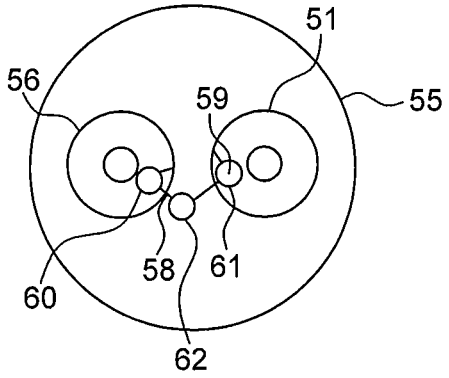
FIG. 4 shows a cross-sectional view taken along the line AA of FIG. 1 with a third alternative embodiment of the present invention.
Figure 5:
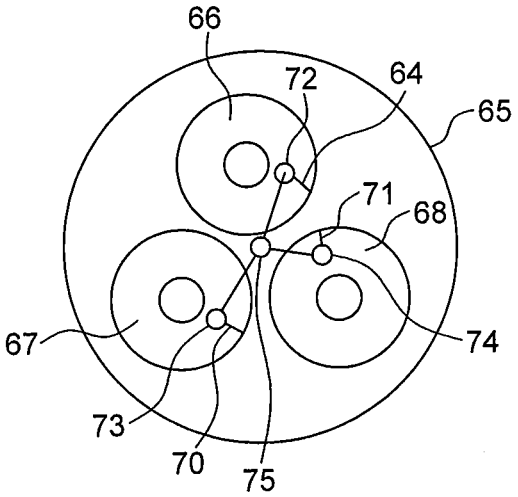
FIG. 5 shows a cross-sectional view taken along the line AA of FIG. 1 for a fourth alternative embodiment of the present invention.

This leaves the alternate embodiments of FIGS. 4 and 5 to discuss. Instead of having upper and lower arrangements of bobbins 47,48 in the pot 45 for FIG. 4, pot 55 could provide for side by side arrangement of bobbins 56,57 which could then direct yarns 58,59 to respective tension devices 60,61, or not, and then to combined tension device 62, if utilized, for such a process. These embodiments could provide striated or parallel yarns 58,59. FIG. 5 shows alternate pot 65 having first, second and third bobbins 66-68 having yarns 69,70,71 being fed to respective tension devices 72,73,74 which then feed the yarns to optional combined tension device 75 which could then direct a yarn upwardly to be combined with ballooning yarn B shown in FIGS. 1 and 3 to provide twisted yarn 17. These options provide a different look to the yarn 17 than when multi-ply yarns are provided as combined yarn 24.

With the various embodiments shown and described herein, many different twisting variations can be provided. Specifically, the various tension devices can be set to different settings to affect the twisted yarn 17. Furthermore, these tensions can be changed on the fly. Each and every yarn, whether there are up to twelve yarns or more, can be changed in tension and their relative placement relative to each other. Additionally, whether the yarns are twisted at the creels 4,26 or in the pot 45,55,65 can be varied before they are even fed to provide the twisted yarn 17 at combining eyelet 9. Only predetermined twisting is shown in the prior art, not striation and not fixed positioning (nor combinations of striation or fixed (i.e., parallel) positioning before predetermined twisting of first and second yarns). Many different creel constructions 4,26 can be provided starting with having at least two positions as is shown in FIG. 1 to having nine or possibly even more positions as shown in FIG. 2 or any number in between. The construction of the pot can be varied form a traditional pot shown in FIG. 1 to having at least two bobbins disposed therein as shown in FIGS. 3 and 4 or even more such as three or more bobbins as shown in FIG. 5 and possibly with additional bobbins in various other constructions.

The controller 18 if utilized, may be able to change the speed of the drive roll 13 as well as speed of the twisting spindle 3 whether on the fly, whether by modulating frequency and/or through other methods, so that a twister work station 1 can provide a plurality of different twisted configurations of various yarns to be utilized to then tuft into carpet to provide many different designs. Controller 18 can vary tensions as discussed herein as well for many embodiments.

In addition to providing yarn for carpets, the twister 1 of the presently preferred embodiments can be utilized for other applications for which the applicant is unaware.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A process for cable-twisting together at least component yarns, including the steps of feeding at least two singles yarn as first and third yarns from a creel to form adjacent creel component yarns and feeding the creel component yarns simultaneously onto a rotating disc, whereby the creel component yarns emerge from the disc and form a balloon, the improvement comprising;

a) feeding at least one singles yarn as a second yarn from a bucket along with a sixth yarn fed from a non-colinear and spaced apart location in the bucket and providing as a bucket component yarn; and b) feeding the bucket component yarn to a yarn guide eyelet, where the creel component yarns emerge from the balloon and wrap around the bucket component yarn to form a cable-twisted yarn comprising at least four component yarns; and wherein the at least two singles yarns feed to a first tension device which applies tension simultaneously to both the first and third yarns; and wherein a second tension device is located between the first tension device and a first yarn supply, with said second tension device applying a controlled preset tension to the first yarn.

2. The method of claim 1 further comprising a third tension device located between the first tension device and a third yarn supply, said third tension device applying a third tension to the third yarn independently of the tension applied by the first tension device to the first yarn.

3. The method of claim 2 further comprising a fourth tension device located between the first tension device and a fourth yarn supply, said fourth tension device applying a fourth tension to a fourth yarn independently of the tension applied by the first tension device to the first yarn, said fourth yarn fed with the first and third yarns as adjacent creel component yarns.

4. The method of claim 2 further comprising a fifth tension device located between the first tension device and a fifth yarn supply, said fifth tension device applying a fifth tension to a fifth yarn independently of the tension applied by the first tension device to the first yarn, said fifth yarn fed with the first, third and fourth yarns as adjacent creel component yarns.

5. The method of claim 1 wherein the first yarn is independently tensioned relative to the third yarn.

6. The method of claim 1 further comprising a seventh yarn originating from the bucket from a source spaced apart and non-colinear with the second yarn and fed simultaneously with the second yarn.

7. The method of claim 6 wherein the seventh yarn is located beside the sixth yarn in the bucket and fed simultaneously with the second yarn.

* * * * *